US005690704A

United States Patent [19]

Hayashi et al.

[11] Patent Number: 5,690,704

[45] Date of Patent: Nov. 25, 1997

[54] ADDITIVE FOR CARBONACEOUS SOLID-WATER SLURRY, METHOD FOR PRODUCTION THEREOF, AND CARBONACEOUS SOLID-WATER SLURRY COMPOSITIONS

[75] Inventors: Kenichiro Hayashi; Satoshi Yamada, both of Kanagawa; Hideyuki Tahara, Osaka; Shoichi Takao, Hyogo, all of Japan

[73] Assignees: Nippon Shokubai Co., Ltd.; Kawasaki Jukogyo Kabushiki Kaisha, both of Japan

[21] Appl. No.: 498,154

[22] Filed: Jul. 5, 1995

[30] Foreign Application Priority Data

Jul. 5, 1994 [JP] Japan ..... 6-153932

[51] Int. Cl.[6] ..... C10L 1/32

[52] U.S. Cl. ..... 44/280

[58] Field of Search ..... 44/280

[56] References Cited

U.S. PATENT DOCUMENTS

| | | | |
|---|---|---|---|
| 4,092,287 | 5/1978 | Ito et al. | 260/29.6 RB |
| 4,100,339 | 7/1978 | Konig et al. | 526/193 |
| 4,330,301 | 5/1982 | Yamamura et al. . | |
| 4,500,445 | 2/1985 | French et al. | 44/280 |
| 4,756,720 | 7/1988 | Kikkawa | 44/280 |
| 4,792,343 | 12/1988 | Hawe et al. | 44/280 |
| 4,872,885 | 10/1989 | Tsulakimoto et al. | 44/280 |

FOREIGN PATENT DOCUMENTS

| | | |
|---|---|---|
| 0278983 | 2/1987 | European Pat. Off. . |
| 0139719 | 12/1980 | Japan . |
| 0128798 | 9/1981 | Japan . |
| 62-20592 | 7/1985 | Japan . |
| 0314501 | 7/1986 | Japan . |
| 63-30596 | 7/1986 | Japan . |
| 63-289096 | 5/1987 | Japan . |
| 63-113098 | 6/1987 | Japan . |
| 03103492 | 9/1989 | Japan . |

OTHER PUBLICATIONS

European Search Report, EP 95 30 4723, Oct. 19, 1995.

*Primary Examiner*—Margaret Medley
*Attorney, Agent, or Firm*—Omri M. Behri, Esq.

[57] ABSTRACT

An additive for a carbonaceous solid-water slurry which excels preeminently in the ability to disperse a finely powdered carbonaceous solid in water and, when used only in a small amount, permits production of a carbonaceous solid-water slurry which possesses high concentration, exhibits high fluidity, and precludes change of viscosity due to aging, a method for the production of the additive, and a slurry composition are provided. The additive to be used for high concentration of carbonaceous solid-water slurry comprises a specific water-soluble copolymer and contains a low molecular copolymer (a) having a weight weight-average molecular weight in a range or from 1000 to 39000 and specific ratios of adsorption relative to a carbonaceous solid and a clayish mineral and a high molecular copolymer (b) having a weight weight-average molecular weight of not less than 40000 and specific ratios of adsorption relative to a carbonaceous solid and a clayish mineral at a weight ratio, (a)/(b), in the range of from 10/90 to 99/1, the met hod is for the production of the additive, and the slurry composition is produced by the incorporation of the additive.

11 Claims, 3 Drawing Sheets

ADDITIVE FOR CARBONACEOUS SOLID-WATER SLURRY, METHOD FOR PRODUCTION THEREOF, AND CARBONACEOUS SOLID-WATER SLURRY COMPOSITIONS

BACKGROUND OF THE INVENTION

1. Field or the Invention

This invention relates to an additive for high-concentration carbonaceous solid-water slurry, a method for the production thereof and a carbonaceous solid-water slurry composition. More particularly, it relates to an additive for effecting dispersion of a carbonaceous solid powder in water thereby giving rise to a carbonaceous solid-water slurry which possess fluidity while maintaining carbonaceous solid at a high concentration, a method for the production thereof and a carbonaceous solid-water slurry composition.

2. Description or the Prior Art

The petroleum which has been heretofore in extensive use as an energy source, is conspicuously rising in price and, at the same time, arousing wide-spread anxiety about exhaustion of the global deposit of petroleum. Thus, the development of other energy source which is inexpensive and stably available, has been set as a task before the industry concerned. Then, carbonaceous solids such as coal and petroleum coke, are on the verge of being put to extensive utilization.

Since coal and petroleum coke are solid at normal room temperature, however, they are at a disadvantage in defying transportation by a pipeline and permitting no easy handling and, because of drift of dust, tending to cause air pollution and open up the possibility of dust explosion and consequently encounter difficulty in the adoption or techniques for their actual use. The development of a technique for fluidifying such carbonaceous solids thereby permitting them to be transported by a pipeline and allowing them to be easily handled and further precluding the possibility of the drift of dust causing air pollution and inducing dust explosion has been demanded.

One of the techniques which are currently available for the purpose of fluidifying the carbonaceous solids in which resultant a carbonaceous solid is tinely pulverized and the resultant fine powder dispersed in a medium, such as methanol or fuel oil, is COM (coal-oil mixture). Since this is not fully satisfactory in terms of stability of supply and price however, the COM is gradually giving place to a high concentration carbonaceous solid-water slurry which uses inexpensive and readily available water as a medium thereof.

This technique for converting a carbonaceous solid into a water slurry is about to be utilized highly extensively not only for the transportation of a carbonaceous solid by a pipeline mentioned above but also for direct combustion and gasification of a carbonaceous solid and for direct utilization of a carbonaceous solid. The perfection of this technique forms an important task in the utilization of carbonaceous solids. This carbonaceous solid-water slurry ought to be a high concentration slurry which has a small water content from the viewpoints of economy and prevention of air pollution. In the case of direct combustion of the carbonaceous solid-water slurry which eliminates the problems of waste water disposal and air pollution, the water content in the slurry ought to be decreased to the fullest possible extent because the carbonaceous solid-water slurry as placed in a cyclone or a turbulent burner and burnt directly therein without undergoing such pretreatments as dehydration and desiccation.

An effort to heighten the concentration of the carbonaceous solid by the well-known technique, however, has entrained the problem that the slurry gains conspicuously in viscosity and loses fluidity. Conversely, when the concentration of the carbonaceous solid in the slurry is lowered, the efficiency of transportation, the efficiency of combustion or the like are degraded. When the carbonaceous solid-water slurry is dehydrated prior to its practical use, the steps of dehydration, desiccation and the like call for extra cost and induce the problem of air pollution.

For the solution of these problems, various dispersants for carbonaceous solid-water slurry have been proposed. Water-soluble copolymers are used as the dispersants, such as formalin condensates of alkylene oxide adducts of phenols (JP-A-59-36,537), partially desulfonated lignin sulfonates (JP-A-58-45,287), naphthalene sulfonates-formalin condensates (JP-A-56-21,636 and JP-A-56-136,665), copolymers of a polyoxyalkylene vinyl monomer with a carboxylic acid monomer (JP-A-63-113,098), and copolymers of a polyoxyalkylene vinyl monomer with a sulfonate-containing vinyl monomer (JP-A-62-121,789).

It is well known that in the production of a carbonaceous solid-water slurry, the temperature of the slurry is raised to a level in the approximate range of from 80° to 90° C. by the heat of pulverization which is generated when the coal in the slurry is pulverized with a ball mill and the heat of agitation which is generated when the slurry is stirred for adjusting the quality of the slurry and that the combined heat exerts such an adverse effect on the ability of a dispersant to disperse carbonaceous solid particles as to degrade the stability of the slurry as evinced by the unstable quality of the produced slurry, and that the deposition of a layer of a high solid concentration in the slurry due to sedimentation of solid particles during the storage of the slurry (JP-B-03-14,501 and JP-A-62-20,592).

The dispersant mentioned above, when put to use, is not capable or imparting fully satisfactory practical stability to the slurry owing to the heats which are generated during the production of the slurry as described above.

The production of the carbonaceous solid-water slurry, therefore, has necessitated incorporation of a cooling device in the system for the production of the slurry and adoption of a complicate procedure as for the control of the temperature of the ball mill and that of the stirring bath. In the circumstance, the development of an additive which permits production of a stable slurry which is neither affected by the temperature of slurry production nor suffered to induce deposition of a layer or high solid concentration during the storage of slurry has been longed for.

Heretofore, as additives for the carbonaceous solid-water slurry, compositions which combine a low molecular polymer with a high molecular polymer have been proposed (JP-A-03-103,492 and JP-A-63-30,596, and JP-A-63-289,096). These dispersants, however, are at a disadvantage in being incapable of retaining a fully satisfactory dispersed state for a long time.

Specifically, the carbonaceous solids, as represented by coal, contain clayish mineral particles. The produced slurry can not be retained intact for a long time unless the mechanism of dispersion produced by the dispersant is manifested in not only the carbonaceous solid but also the clayish mineral particles. The aforementioned dispersants which are devoid of viscosity with respect to the clayish mineral particles, therefore, are not capable of retaining a fully satisfactory dispersed state for a long time.

The present inventors have continued a diligent study with a view to solving the problem mentioned above and consequently found that a carbonaceous solid-water slurry which has incorporated therein a mixture of copolymers possessing specific weight-average molecular weights and selected from among specific water-soluble copolymers retains the dispersibility thereof intact in spite of the heats generated during the production of the slurry, exhibits satisfactory fluidity even at a high concentration, and manifests an excellent effect in preventing carbonaceous solid particles from being sedimented during the storage of the slurry. This invention has been perfected as a result.

An object of this invention is, therefore, to provide an additive for permitting easy production of a carbonaceous solid-water slurry which retains the dispersibility thereof intact in spite of the heats generated during the production of the slurry, exhibits fluidity even at a high concentration, and excels in stability in storage.

Another object of this invention is to provide a method for the production of an additive for a carbonaceous solid-water slurry which exhibits fluidity even at a high concentration and excels in stability in storage.

Still another object of this invention is to provide a carbonaceous solid-water slurry composition which retains the dispersibility thereof intact in spite of the heats generated during the production of the slurry, exhibits fluidity even at a high concentration, and excels in stability in storage.

Yet another object of this invention is to provide an additive for a carbonaceous solid-water slurry which is easily adsorbed on not only carbonaceous solids but also clayish mineral particles and a method for the production of the additive.

SUMMARY OF THE INVENTION

According to the present invention, there is provided an additive for a high concentration carbonaceous solid-water slurry comprising one or more members selected from the group of water-soluble copolymers obtained by polymerizing the monomer components, (A) from 0.2 to 20 mol % of a nonionic monomer represented by the formula (I):

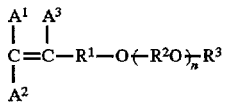

(I)

wherein $R^1$ stands —$CH_2$—, —$(CH_2)_2$—, —$(CH_2)_3$—, —$C(CH_3)_2$. —CO—, or —$CH_2CO$—, $A^1$, $A^2$, and $A^3$ independently stand for a hydrogen atom or a methyl group where $R^1$ is —$CH_2$—, —$(CH_2)_2$—, —$(CH_2)_3$—, or —$C(CH_3)_2$— or $A^1$ and $A^2$ independently stand for a hydrogen atom, a methyl group, or —COOX and $A^1$ and $A^2$ do not simultaneously stand for —COOX and $A^3$ stands for a hydrogen atom, a methyl group, —COOX, or —$CH_2COOX$ where $R^1$ is CO or —$CH_2CO$ and $A^1$ and $A^2$ independently stand for a hydrogen atom or a methyl group where $A^3$ is —COOX or —$CH_2COOX$, wherein X stands for a hydrogen atom, an alkali metal atom, an alkaline earth metal atom, an ammonium group, or an organic amine group $R^2$ stands for an alkylene group or 2 to 4 carbon atoms, n stands for a number of an average in the range of from 1 to 100, $R^3$ stands for an alkyl group of 1 to 30 carbon atoms, an alkenyl group, an aryl group, an aralkyl group, a cyclic alkyl group, or a cyclic alkenyl group, or a monovalent organic group derived from a heterocyclic compound, (B) from 50 to 99.8 mol % of at least one anionic monomer selected from the group consisting of (B-1) an unsaturated carboxylic acid monomer represented by the formula (II):

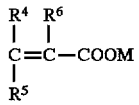

(II)

wherein $R^4$ and $R^5$ independently stand for a hydrogen atom, a methyl group, or —COOM and $R^4$ and $R^5$ do not simultaneously stand for —COOM, $R^6$ stands for a hydrogen atom, a methyl group, or —$CH_2COOM$, providing that $R^4$ and $R^5$ independently stand for a hydrogen atom or methyl group where $R^6$ is —$CH_2COOM$, and M stands for a hydrogen atom, an alkali metal atom, an alkaline earth metal atom, an ammonium group, or an organic amine group and (B-2) a sulfoalkyl(meth) acrylate type monomer represented by the formula (III):

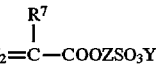

(III)

wherein $R^7$ stands for a hydrogen atom or a methyl group, Z stands for an alkylene group of 1 to 4 for carbon atoms, and Y stands for a hydrogen atom, an alkali metal atom, an alkaline earth metal atom, an ammonium group, or an organic amine group, and (C) from 0 to 49.8 mol % of other monomer copolymerizable with the monomers mentioned above provided the total of the monomers of (A), (B-1), (B-2), and (C) is 100 mol % and whereby there is produced (a) a water soluable low molecular copolymer of (A)+(B)+(C) having a weight-average molecular weight in a range or from 1000 to 39000, an adsorption ratio relative to carbonaceous solids in a range of from 5 to 50%, and an adsorption ratio relative to clayish mineral particles in the range of from 5 to 40% and (b) a water soluable high molecular copolymer having a weight-average molecular weight in a range not less than 40000, an adsorption ratio relative to carbonaceous solids in a range not less than 50%, and an adsorption ratio relative to clayish mineral particles in a range not less than 40% at a weight ratio, (a)/(b), in the range of from 10/90 to 99/1.

This invention further concerns the additive mentioned above, which further comprises a chelating agent. This invention further concerns the additive mentioned above, wherein the chelating agent is at least one member selected from the group consisting of pyrophosphoric acid, tripolyphosphoric acid, hexametaphosphoric acid, and alkali metal salts, alkaline earth metal salts, ammonium salts, and amine salts thereof.

According to the present invention, there is provided a method for the production of an additive for a high concentration carbonaceous solid-water slurry which comprises mixing a lower molecular copolymer (a) comprising one or more water-soluble copolymers mentioned above and having a weight-average molecular weight in a range of from 1000 to 39000 with a high molecular copolymer (b) mentioned above having a weight-average molecular weight of not less than 40000 at a weight ratio, (a)/(b), in the range of from 10/90 to 99/1.

According to the present invention there is provided a carbonaceous solid-water slurry composition which comprises from 40 to 90% by weight or more of a finely powdered carbonaceous solid and from 0.02 to 2% by weight, based on the amount of the finely powdered carbonaceous solid mentioned above, of an additive mentioned above.

The additive of this invention for use in a carbonaceous solid-water slurry is preeminently excellent in the ability to disperse the finely powdered carbonaceous solid in water and free from the influence of the heat which is generated during the production of a carbonaceous solid-water slurry. The use of this additive in a small amount permits provision of a carbonaceous solid-water slurry which possesses high concentration and high fluidity and incurs no change of viscosity due to aging.

The additive of this invention, after being adsorbed on a carbonaceous solid, manifests an action of stabilizing dispersion of the carbonaceous solid by the low molecular copolymer (a) dispersing the solid particles, heightening the concentration of solid in the slurry and, at the same time, imparting fluidity to the slurry and the high molecular copolymer (b), on account of the high bulkiness inherent therein, weakly cross-linking the adjacent solid particles thereby enabling the whole of the slurry to acquire a structure not so strong as to impair the fluidity of the slurry.

The additive is likewise adsorbed on the clayish mineral contained in the carbonaceous solid and then enabled to manifest the same action of stabilizing dispersion of the clayish mineral as in the carbonaceous solid.

Owing to the action of adsorption manifested as described above on these two solid components, the additive permits production of a carbonaceous solid-water slurry which enjoys a high concentration and excels in stability in protracted storage. It should be noted that the additive is readily obtained by mixing a low molecular one and a high molecular one selected from among such specific water-soluble copolymers as mentioned above.

When the high concentration carbonaceous solid-water slurry which is obtained by the use of the additive of this invention for a carbonaceous solid-water slurry is adopted, conveyance of a carbonaceous solid by a pipeline can be implemented highly economically. Thus, the problems encountered by the carbonaceous solid as a solid substance in terms of storage, transportation, and combustion can be eliminated.

The additive of this invention for use in a carbonaceous solid-water slurry, therefore, can contribute in a great measure to disseminate the technique for direct combustion of a carbonaceous solid, that for gasification of a carbonaceous solid, or the like.

DESCRIPTION OF THE PREFERRED EMBODIMENT

Figure 1:
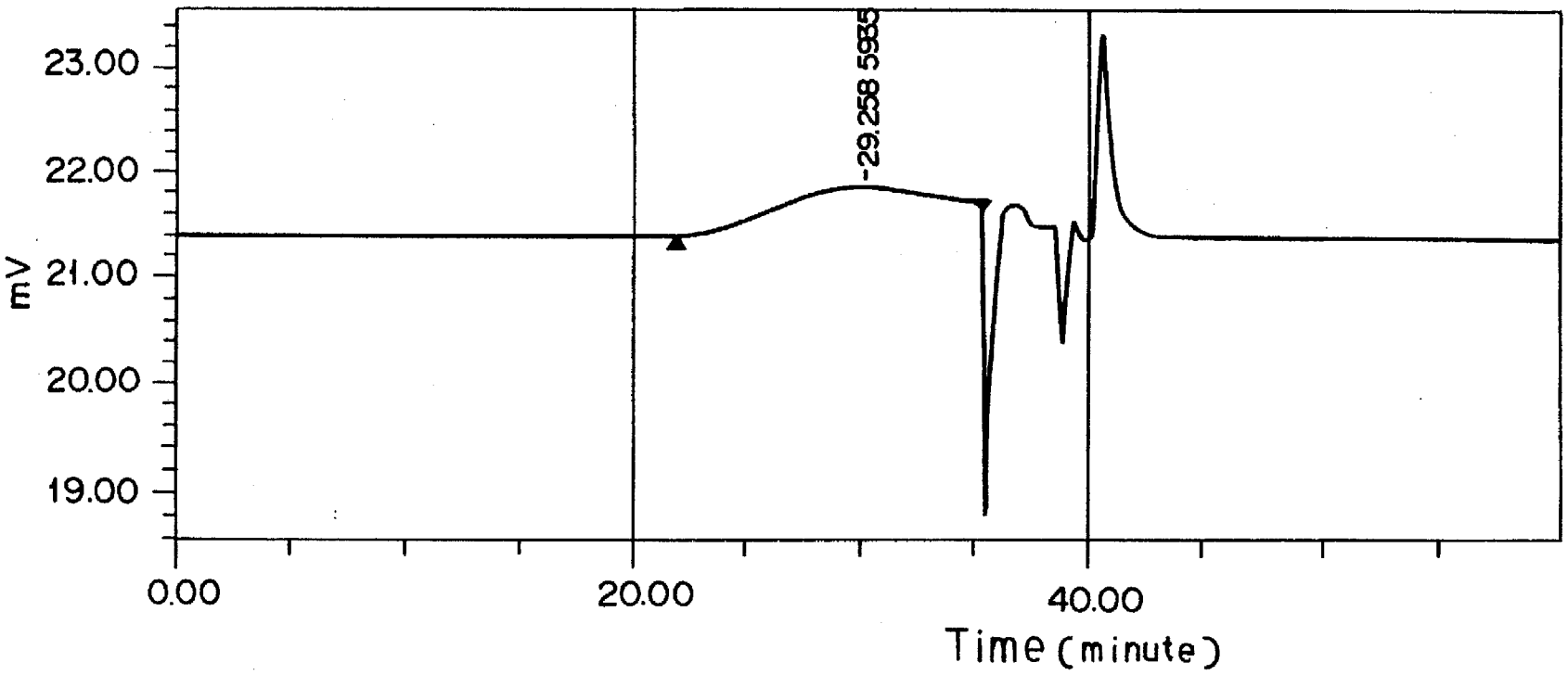
FIG. 1 is a chart of measurement by Gel Permeation Chromatography (GPC) of the weight weight-average molecular weight of a low molecular copolymer for use in the present invention.

As concrete examples of the carbonaceous solids contemplated by this invention, coal coke and petroleum coke may be cited. This invention does not discriminate the coal on account of kind, place of production, water content, or chemical composition but permits use of coal of any sort. Anthracite, bituminous coal, subbituminous coal, and lignite may be cited as concrete examples.

The carbonaceous solid of the quality described above, prior to use, is pulverized generally by the well-known wet or dry method into particles such that not less than 50% by weight, preferably from 70 to 90% by weight, thereof pass 200 mesh. The slurry concentration is generally in a range of from 40 to 90% by weight, preferably from 50 to 90% by weight, on the dry basis of finely pulverized coal. If the slurry concentration is less than 40% by weight, it will prove impracticable in terms of economy, efficiency of conveyance, and efficiency of combustion. Conversely, if it exceeds 90% by weight, it will render formation of a slurry difficult.

The water-soluble copolymer which effectively functions as the additive of this invention for use in a carbonaceous solid-water slurry is obtained by polymerizing the raw material monomer components, i.e. from 0.8 to 20 mol % of the monomer (A), from 50 to 99.8 mol % of the monomer (B-1) and/or the monomer (B-2), from 0 to 49.8 mol % of the monomer (C), provided the total of the monomers (A), (B-1), (B-2), and (C) is 100 mol %.

The water-soluble copolymer mentioned above is advantageously obtained by polymerizing 6 the raw material monomer components, i.e. from 0.to 10 mol 1% of the monomer (A), from 70 to 99.8 mol % of the monomer (B-1) and/or the monomer (B-2), and from 0 to 29.8 mol % of the monomer (C), provided the total of the monomers (A), (B-1), (B-2), and (C) is 100 mol %, In the formula (I), $A^1$ and $A^2$ independently stand for a hydrogen atom, a methyl group, or —COOX, provided X stands for a hydrogen atom, an alkali metal atom, an alkaline earth metal atom, an ammonium group, or an organic amine group of 1 to 6 carbon atoms, $A^1$ and $A^2$ do not simultaneously stand for —COOX, and they preferably stand each for a hydrogen atom. $A^3$ stands for a hydrogen atom, a methyl group, —COOX, or —$CH_2$COOX, provided X has the same meaning as defined above. $A^1$ and $A^2$ independently stand for a hydrogen atom or a methyl group where $A^3$ is —COOX or —$CH_2$COOX. In any event, $A^3$ preferably stands for a hydrogen atom or a methyl group. $R^1$ stands for —$CH_2$—, —$(CH_2)_2$—, —$(CH_2)_3$—, —$C(CH_3)_2$—, —CO—, or —$CH_2$CO—, preferably for —$CH_2$—, —$(CH_2)_2$—, or —CO—. $R^2$ stands for an alkylene group of 2 to 4, preferably 2 or 3, carbon atoms. Then, n stands for a numeral of an average in a range of from 1 to 100, preferably from 5 to 70. $R^3$ stands for an alkyl group having from 1 to 30, preferably from 1 to 20, carbon atoms, an alkenyl group, an aryl group, an aralkyl group, a cyclic alkyl group, or a cyclic alkenyl group, or a monovalent organic group derived from a heterocyclic compound, preferably an alkyl group, an aryl group, an aralkyl group, or a cyclic alkyl group. X has the same meaning as defined above.

In the formula (II), $R^4$ and $R^5$ independently stand for a hydrogen atom, a methyl group, or —COOM, they do not simultaneously stand for —COOM, and they preferably stand for a hydrogen atom or —COOM. $R^6$ stands for a hydrogen atom, a methyl group, or —$CH_2$COOM. $R^4$ and $R^5$ independently stand for a hydrogen atom or methyl group where $R^6$ is —$CH_2COOM$. M stands for a hydrogen atom, an alkali metal atom, an alkaline earth metal atom, an ammonium group, or an organic amine group, preferably for an alkali metal atom, an alkaline earth metal atom, or an ammonium group.

In the formula (III), $R^7$ stands for a hydrogen atom or a methyl group. Z stands for an alkylene group of 1 to 4, preferably 2 or 3, carbon atoms, Y stands for a hydrogen atom, an alkali metal atom, an alkaline earth metal atom, an ammonium group, or an organic amine group, preferably for an alkali metal atom, an alkaline earth metal atom, or an ammonium group.

The monomer (A) is represented by the formula (I) mentioned above and can be obtained by any of the methods known in the art. As concrete examples of the monomer (A), terminal ether compounds having the hydrogen atom in the terminal hydroxyl group of compounds resulting from the addition of 1 to 100 mols of ethylene oxide, propylene oxide and/or butylene oxide to 1 mol of an unsaturated alcohol, such as 2-propen-1-ol (allyl alcohol), 2-methyl-2-propen-1-ol, 2-buten-1-ol, 3-methyl-3-buten-1-ol, 3-methyl-2-buten-1-ol, or 2-methyl-3-buten-2-ol substituted by other substituent such as, for example, an alkyl group of 1 to 30 carbon atoms like methyl, ethyl, propyl, butyl, dodecyl, octadecyl, or propenyl group, an alkenyl group, an aryl group like phenyl, p-methylphenyl, nonylphenyl, chlorophenyl, naphthyl, anthryl, or phenanthryl group, an alkyl group having as a substituent thereof an aryl group like benzyl, p-methyl-benzyl, or phenylpropyl group, a cyclic alkyl group like cyclohexyl group, a cyclic alkenyl group like cyclopentenyl group, or an organic group like pyridyl group or thienyl group derived from a heterocyclic compound; alkoxypolyalkylene glycol mono(meth)acrylates alkoxylated with alkyl groups of up to 30 carbon atoms like methoxypolyethylene glycol mono(meth)acrylates, methoxypolypropylene glycol mono(meth)acrylates, methoxypoly-butylene glycol mono(meth)acrylates, ethoxypolyethylene glycol mono(meth)acrylates, ethoxypolypropylene glycol mono(meth)-acrylates, ethoxypolybutylene glycol (meth)acrylates, methoxy-polyethylene glycol-polypropylene glycol mono(meth)acrylates, dodecylpolyethylene glycol mono(meth)acrylates, octadesiloxypolyethylene glycol mono(meth)acrylates, and others; alkenoxy-polyalkylene glycol mono(meth)acrylates alkenoxylated with alkenyl groups of up to 30 carbon atoms; alkenoxy-polyalkylene glycol mono (meth) acrylates alkenoxylated with alkenyl groups of up to 30 carbon atoms; aryloxypolyalkylene glycol mono(meth)acrylates like phenoxypolyethylene glycol mono(meth)acrylates, naphthoxypolyethylene glycol mono(meth)acrylates, phenoxypolypropylene glycol mono(meth)acrylates, naphthoxypolyethylene glycol-polypropylene glycol mono(meth)-acrylates, and p-methylphenoxypolyethylene glycol mono(meth)-acrylates; aralkyloxypolyalkylene glycol mono(meth) acylates like benzyloxypolyethylene glycol mono(meth) acrylates and benzyloxy-polypropylene glycol mono(meth) acrylates; cyclic alkoxypoly-alkylene glycol mono(meth) acrylates like cyclohexoxypolyethylene glycol mono(meth) acrylates; cyclic alkenoxypolyalkylene glycol mono(meth) acrylates like cyclopentanoxypolyethylene glycol mono-(meth)acrylates; heterocyclic ethers like pyridyloxypolyethylene glycol mono(meth)acrylates, pyridinylpolypropylene glycol mono-(meth)acrylates, and thienyloxypolyethylene glycol mono(meth)-acrylates; and unsaturated polycarboxylic monoesters of monoetherified polyalkylene glycols like methoxypolypropylene glycol monomaleate, phenoxypolyethylene glycol monomaleate, naphthoxypolypropylene glycol monoitaconate, naphthoxypolyethylene glycol monocrotonate, and phenoxypolyethylene glycol monoitaconate may be cited. These monomers may be used either singly or in the form of a mixture of two or more members.

The monomer (B-1) Is represented by the formula (II) mentioned above and can be obtained by any of the methods known In the art. As concrete examples of the monomer (B-1), acrylic acid, mothacrylic acid, crotonic acid, itaconic acid, maleic acid, fumaric acid, and citraconic acid, sodium, potassium and other alkali metal salts, magnesium, calcium, and other alkaline earth metal salts, ammonium salts, or organic amine salts of the acids mentioned above may be cited. These monomers may be used either singly or in the form of a mixture of two or more members.

The monomer (B-2) is represented by the formula (III) and can be likewise obtained by any of the methods known in the art. As concrete examples of the monomer (B-2), 2-sulfoethyl(meth)acrylates , 3-sulfopropyl(meth)acrylates, 2-sulfopropyl(meth)acrylates, 1-sulfopropan-2-yl(meth) acrylates, and 4-sulfobutyl(meth)acrylates, sodium, potassium and other alkali metal salts, magnesium, calcium, and other alkaline earth metal salts, ammonium salts, or organic amine salts of the acids mentioned above may be cited. These monomers may be used either singly or in the form of a mixture of two or more members.

The monomer (C) is other monomer which is polymerizable with the monomers (A), (B-1), and (B-2) and is optionally used in an amount not so large as to impair the effect of this invention. As concrete examples of the monomer (C), (meth)acrylic acid alkyl esters, such as methyl (meth)acrylates, ethyl (meth)acrylates, and isopropyl (meth) acrylates; various sulfonic acids other than the monomer (B-2) like vinyl sulfonic acid, styrene sulfonic acid, allyl sulfonic acid, methallyl sulfonic acid, and 2-acrylamide-2-methylpropane sulfonic acid, and monovalent metal salts, divalent metal salts, ammonium salts, and organic amine salts or the acids mentioned above; hydroxyl group-containing monomers, such as hydroxyethyl (meth)acrylates and polyethylene glycol mono(meth)acrylates; various (meth)acrylamides like (meth)acrylamides and N-methylol (meth)acrylamides; aromatic vinyl compounds like styrene and p-methyl styrene; and vinyl acetate, propenyl acetate, and vinyl chloride may be cited. These monomers may be used either singly or in the form of one or more members.

If these monomers (A), (B-1), (B-2), and (C) are used in amounts deviating from the ranges of mixing ratios mentioned above, there will not be obtained a copolymer which excels in the ability to disperse a carbonaceous solid in water.

The polymerization in a solvent can be carried out either batchwise or continuously. As concrete examples of the solvent which is used for this polymerization, water; lower alcohols, such as methyl alcohol, ethyl alcohol, and isopropyl alcohol; aromatic, aliphatic, or heterocyclic hydrocarbons, such as benzene, toluene, xylene, cyclohexane, n-heptane, and dioxane; ester compounds, such as ethyl acetate; and ketone compounds, such as acetone and methylethyl ketone may be cited. From the viewpoint of the solubility of the raw material monomers and that of the produced water-soluble copolymer and the convenience of use of the copolymer, it is advantageous to use water or at least one member selected from the group consisting of lower alcohols of one to four carbon atoms among other solvents cited above.

In the polymerization which is implemented by using water as a solvent, a water-soluble polymerization initiator, such as, ammonium, a persulfate of an alkali metal, or hydrogen peroxide, is to be used. In this case, an accelerator, such as, sodium hydrogen sulfite may be used in combination with the polymerization initiator. When a lower alcohol, an aromatic hydrocarbon, an aliphatic hydrocarbon, an ester compound, or a ketone compound is used as a solvent, the polymerization initiators which are advantageously used for the polymerization include peroxides, such as benzoyl peroxide and lauroyl peroxide; hydroperoxides, such as cumene hydroperoxide; and aliphatic azo compounds, such as azo-bis-isobutyronitrile. When a mixed solvent of water with a lower alcohol is used, a polymerization initiator suitably selected from among the various polymerization initiators can be used either singly or in combination with a promoter likewise selected suitably. The amount of the polymerization initiator to be used is in a range of from 0.01 to 10% by weight, preferably from 0.1 to 5% by weight, based on the amount of the monomer mixture. When the accelerator is additionally used, the amount thereof is in a range of from 0.01 to 10% by weight, preferably from 0.1 to 5% by weight, based on the amount of the monomer mixture.

The temperature of the polymerization which is suitably fixed depending on the kind or solvent and that of polymerization initiator to be used is generally in a range of from 0° to 150° C., preferably from 30° to 120° C.

The polymerization initiators which can be used in bulk polymerization include peroxides, such as benzoyl peroxide and lauroyl peroxide; hydroperoxides, such as cumene hydroperoxide; and aliphatic azo compounds, such as azo-bis-isobutyronitrile. This polymerization is carried out at a temperature in the range of from 50° to 150° C., preferably from 60° to 130° C. The amount of the polymerization initiator to be used in a range of from 0.01 to 10% by weight, preferably 0.1 to 5% by weight, based on the amount of the monomer mixture.

For the preparation of the additive of this invention, a low molecular copolymer (a) and a high molecular copolymer (b) are used in combination among other copolymers mentioned above.

When the low molecular copolymer (a) and the high molecular copolymer (b) are separately polymerized, the respective molecular weights can be adjusted by any of the methods known to the art.

As means to adjust such a molecular weight, a method which accomplishes the adjustment by the amount of a polymerization initiator, a method which carries out the adjustment by the temperature of polymerization, and a method which implements the adjustment by the concentration or polymer may be cited. The adjustment of the molecular weight can otherwise be attained by the method for charging or introducing monomer components, a polymerization initiator, and/or a chain transfer agent.

The high molecular copolymer (b) can use a cross-linking agent during the polymerization thereof. As concrete examples of the cross-linking agent, ethylene glycol di(meth)acrylates, diethylene glycol di(meth)acrylates, polyethylene glycol di(meth)-acrylates, trimethylol propane di(meth)acrylates, trimethylol propane tri(meth)acrylates, methylenebisacrylamide, diallyl phthalate, and divinyl benzene may be cited.

The low molecular copolymer (a) to be used has a weight-average molecular weight in a range of from 1000 to 39000, preferably from 3000 to 39000. The ratio of adsorption of the low molecular copolymer (a) relative to the carbonaceous solid is in a range of from 5 to 50%, preferably from 10 to 50% and that relative to the clayish mineral is in a range of from 5 to 40%, preferably from 10 to 40%.

The high molecular copolymer (b) to be used has a weight-average molecular weight of not less than 40000, preferably from 100000 to 2,000,000. The ratio of adsorption or the high molecular copolymer (b) relative to the carbonaceous solid is not less then 50%, preferably not less than 55% and that relative to the clayish mineral is not less than 40%, preferably not less than 45%. The additive of this invention for a carbonaceous solid-water slurry is characterized by using the low molecular copolymer and the high molecular copolymer in combination. These copolymers are thought to function as follows.

To attain dispersion of a carbonaceous solid in water, it is necessary that the copolymers be first adsorbed on the surface of the solid. After the additive has been adsorbed, the low molecular copolymer (a) disperses solid particles, heightens the solid concentration in the slurry and, at the same time, imparts fluidity to the slurry and the high molecular copolymer (b), on account of the high bulkiness inherent therein, weakly cross-links the adjacent solid particles thereby enables the whole of the slurry to acquire a structure not so strong as to impair the fluidity of the slurry. Owing to these adsorbing actions, the additive permits provision of a carbonaceous solid-water slurry enjoying high concentration and excelling in stability in storage.

The additive of this invention for use in a carbonaceous solid-water slurry is prepared for use by having the low molecular copolymer (a) and the high molecular copolymer (b) compounded in a mixing ratio, (a)/(b), in the range of from 10/90 to 99/1, preferably from 40/60 to 95/5, by weight. If the mixing ratio deviates from the range mentioned above, the effect of the additive will be equal to what is obtained when the low molecular copolymer (a) or the high molecular copolymer (B) is independently used. In other words, no sufficient effect is obtained in preventing the sedimentation of the carbonaceous solid during the storage of the slurry, though the viscosity of the carbonaceous solid-water slurry is lowered and the fluidity thereof is improved.

In general, the heat which is generated during the production of the carbonaceous solid-water slurry lowers the ability of the additive to disperse the solid in the slurry, degrades the stability of the slurry during the storage thereof, and induces eventual formation of a sedimented layer having a high solid concentration.

The additive of this invention for use in a carbonaceous solid-water slurry is used with the low molecular copolymer (a) and the high molecular copolymer (b) as combined in the mixing ratio mentioned above. In this case, the low molecular copolymer (a) and the high molecular copolymer (b) may be prepared by separate polymerization and then mixed with each other prior to use. Otherwise, the mixture of the low molecular copolymer (a) and the high molecular copolymer (b) may be produced by simultaneous polymerization and put to use.

For the production of the mixture of the low molecular copolymer (a) and the high molecular copolymer (b) by means of simultaneous polymerization, a method which obtains a mixture of a low molecular copolymer (a) and a high molecular copolymer (b) as by altering the amount of a polymerization initiator or the amount of a chain transfer agent in the process of polymerization or changing the temperature of polymerization during the course of polymerization may be adopted. In this case, the composition or the monomer being polymerized may be kept constant from the start to the end of polymerization or may be changed during the course of polymerization.

The amount or the additive of this invention to be used in the carbonaceous solid-water slurry is not particularly limited but may be selected in a wide range. From the economic point of view, this amount is in a range or from 0.02 to 2% by weight, preferably from 0.1 to 1% by weight, based on the weight (on dry basis) of the finely powdered carbonaceous solid.

The use of the additive of this invention in a carbonaceous solid-water slurry may be implemented by mixing the carbonaceous solid with the additive in preparation for conversion of this carbonaceous solid into a slurry or by having the additive dissolved in water prior to the conversion of the carbonaceous solid into a slurry. Naturally, the additive may be used in the prescribed amount either wholly at once or piecemeal. It is also permissible to combine the low molecular copolymer (a) and the high molecular copolymer (b) with each other preparatorily to the addition or to add them separately of each other.

When the low molecular copolymer (a) and the high molecular copolymer (b) are to be used as mixed with each other, the low molecular copolymer (a) and the high molecular copolymer (b) which have been separately polymerized may be used as mixed with each other or the low molecular copolymer (a) and the high molecular copolymer (b) which have been polymerized in a coexistent state in one and the same solution may be used.

The additive is such in quality that the device to be used for converting the carbonaceous solid into a water slurry may be any of the known devices which are capable of effecting this conversion at all.

The method of addition and the method of conversion into a slurry mentioned above impose absolutely no limit on the scope of this invention.

The additive of this invention for use in the carbonaceous solid-water slurry may optionally incorporate additionally therein a sedimentation preventing agent and a chelating agent.

As concrete examples of the sedimentation preventing agent, natural macromolecules, such as xanthane gum and guayule rubber; cellulose derivatives, such as carboxymethyl cellulose and hydroxyethyl cellulose; and clayish mineral substances, such as montmorillonite, attapulgite, bentonite, kaolinite, and sepiolite may be cited. The amount of the sedimentation preventing agent to be incorporated in the additive is in a range of from 0.001 to 0.5% by weight, preferably 0.003 to 0.3% by weight, based on the amount of the slurry.

As concrete examples of the chelating agent, oxalic acid, malonic acid, succinic acids lactic acid, malic acid, tartaric acid, citric acid, glucuronic acid, glycolic acid, diglycolic acid, iminodiacetic acid, nitrotriacetic acid, ethylenediamine tetraacetic acid, pyrophosphoric acid, tripolyphosphoric acid, hexametaphosphoric acid, glycine, and alanine, and alkali metal salts, alkaline earth metal salts, ammonium salts, and amine salts thereof may be cited. It is particularly advantageous to use at least one member selected from the group consisting of pyrophosphoric acid, tripolyphosphoric acid, and hexameta-phosphoric acid and alkali metal salts, alkaline earth metal salts, ammonium salts, and amine salts thereof. The amount of the chelating agent to be incorporated in the additive is in a range of from 0.02 to 3% by weight, preferably from 0.1 to 2% by weight, based on the amount of the carbonaceous solid.

Optionally, the additive of this invention for use in a carbonaceous solid-water slurry may additionally incorporate therein a pH adjusting agent, a rust preventive agent, a corrosion protecting agent, an antioxidant, a defoaming agent, an antistatic agent, a solubilizing agent, and the like.

When the additive of this invention for a carbonaceous solid-water slurry is used in combination with a pH adjusting agent, the pH value of the carbonaceous solid-water slurry is generally not less than 4, preferably in a range of from 7 to 10.

The production of the additive of this invention for the carbonaceous solid-water slurry is carried out by mixing the two water-soluble copolymers having the specific weight-average molecular weights mentioned above. Though this mixture of the copolymers may be effected by using these copolymers both in the form of powders, it can be accomplished by adding the copolymers in prescribed amounts to water or by combining the copolymers both in the form of aqueous solutions.

The carbonaceous solid-water slurry composition is produced by adding a prescribed amount of a finely powdered carbonaceous solid to the aqueous solution obtained as described above and then mixing them.

EXAMPLES

Now, the additive of this invention for a carbonaceous solid-water slurry will be described more specifically below with reference comparative examples and examples. It should be noted, however, that this invention is not limited to these examples. Wherever parts and percents are mentioned in the following examples, they shall be construed as referring to parts by weight and percents by weight unless otherwise specified.

The ratios of adsorption were determined by the following methods.

Ratio or adsorption relative to carbonaceous solid

An aqueous solution containing 0.5% by weight of a copolymer was kept stirred at room temperature with a stirrer (R type using a 4-vane propeller 50 mm in diameter) at 1000 rpm and a carbonaceous solid pulverized into particles 80% of which passed 200 mesh was added in a prescribed amount to the stirred aqueous solution to prepare a slurry containing the carbonaceous solid at a concentration of 50% by weight. After the addition of the whole amount of the carbonaceous solid was completed, the slurry was stirred at 1000 rpm for five minutes and then treated with a centrifugal separator at 1500 G for 10 minutes to be separated into solid and liquid. The water layer consequently obtained was passed through a filter of 0.45 μm to determine the total organic carbon concentration (TOC-1) in the water layer. Separately, an aqueous solution containing 0.5% by weight of the same copolymer as used in the preparation of the slurry was tested for total organic carbon concentration (TOC-2). Then, the ratio of adsorption was computed in accordance with the following formula.

$$\text{Ratio of adsorption (\%)}=\{1-(\text{TOC-1})\div(\text{TOC-2})\}\times 100$$

Ratio of adsorption relative to clayish mineral substance

The ratio of adsorption relative to a clayish mineral substance was determined by following the procedure used as described above for the determination of the ratio of adsorption relative to a carbonaceous solid while using bentonite produced by Wako Pure Chemical Industries Ltd. as a clayish mineral substance and using an aqueous solution containing a copolymer at a concentration of 0.056% by weight. A slurry was prepared such that the concentration of the bentonite was 10% by weight.

Synthetic Example 1

A reaction vessel of glass provided with a thermometer, a stirrer, a gas inlet tube, and a reflux condenser was charged with 300 parts of water. The air entrapped in the reaction vessel was displaced with nitrogen while the water was kept stirred and the reaction vessel was heated to 95° C. in the ambience of nitrogen. A mixture consisting of 73.7 parts of methoxypolyethylene glycol monoacrylate (average number of mols of ethylene oxide added 20), 26.3 parts of methacrylic acid, and 400 parts of water and a mixture consisting of 4 parts of ammonium persulfate and 176 parts of water were severally added with a pump into the reaction vessel over a period of 120 minutes. After the addition of the mixtures was completed, a solution of 1 part of ammonium persulfate in 20 parts of water was further added thereto over a period of 30 minutes. After the addition of the aqueous solution was completed, the reactants were kept at a temperature of 95° C. for 30 minutes to complete the reaction of polymerization. Thereafter, the product of the polymerization was completely neutralized with an aqueous potassium hydroxide solution to obtain a low molecular copolymer (a-1).

Synthetic Example 2

The same reaction vessel as used in Example 1 of Synthesis was charged with 300 parts of water. The air entrapped in the reaction vessel was displaced with nitrogen with the water kept stirred and the reaction vessel was heated to 95° C. in the ambience of nitrogen. Then, a mixture consisting of 21.2 parts of phenoxypolyethylene glycol monomethacrylate (average number of mols of ethylene oxide added 20), 42.9 parts of methacrylic acid, 35.9 parts of acrylic acid, 3 parts of mercaptoethanol as a chain transfer agent, and 397 parts of water and a mixture consisting of 2 parts of ammonium persulfate and 178 parts of water were severally added with a pump to the reaction vessel over a period of 120 minutes. After the addition of the mixtures was completed, a solution of 1 part of ammonium persulfate in 20 parts of water was further added thereto over a period of 30 minutes. After the addition of the aqueous solution was completed, the reactants were kept at a temperature of 95° C. for 30 minutes to complete the polymerization reaction. Thereafter, the product of the polymerization was completely neutralized with monoethanol amine to obtain a low molecular copolymer (a-3).

Synthetic Example 3

A high molecular polymer (b-1) was obtained by following the procedure of synthetic Example 1 while changing the amount of water placed in the reaction vessel to 100 parts, decreasing the amount of ammonium persulfate initially added to 1 part, and using sodium hydroxide instead as a neutralizing agent to be used at the end of the polymerization reaction.

Other low molecular copolymers (a) and high molecular copolymers (b) were obtained by performing the polymerizations of synthetic Examples 1 to 3 while suitably varying the amount of initiator, the amount of chain transfer agent, and the polymerization concentration.

This invention is not limited in any way by these Synthetic examples.

Examples 1 to 70

The aqueous solutions of low molecular copolymers (1) to (17) and high molecular copolymers (1) to (17) were obtained by polymerizing monomers (A), monomers (B-1), monomers (B-2), and monomers (C) shown in Tables 1 to 6 at monomer compositions (mol %) indicated in Tables 1 to 6 while suitably adjusting the amount of initiator, the amount of chain transfer agent, and the polymerization concentration in the same manner as in synthetic Examples 1 to 3.

Aqueous solutions prepared to contain the copolymers (1) to (17) in the amounts shown in Tables 7 to 10 were kept at slurry preparation temperatures indicated in Tables 11 to 14 and a carbonaceous solid pulverized into particles 80% of which passed 100 mesh was added piecemeal into the stirred aqueous solutions. After the addition of the carbonaceous solid to the varying concentrations shown in Tables 11 to 14 was completed, the resultant reactants were stirred with a homomixer (produced by Tokushu Kikako K.K. in Japan) at 5000 rpm for 10 minutes to obtain carbonaceous solid-water slurries. In this while, these slurries were continuously kept at preparation temperatures shown in Tables 11 to 14.

Figure 2:
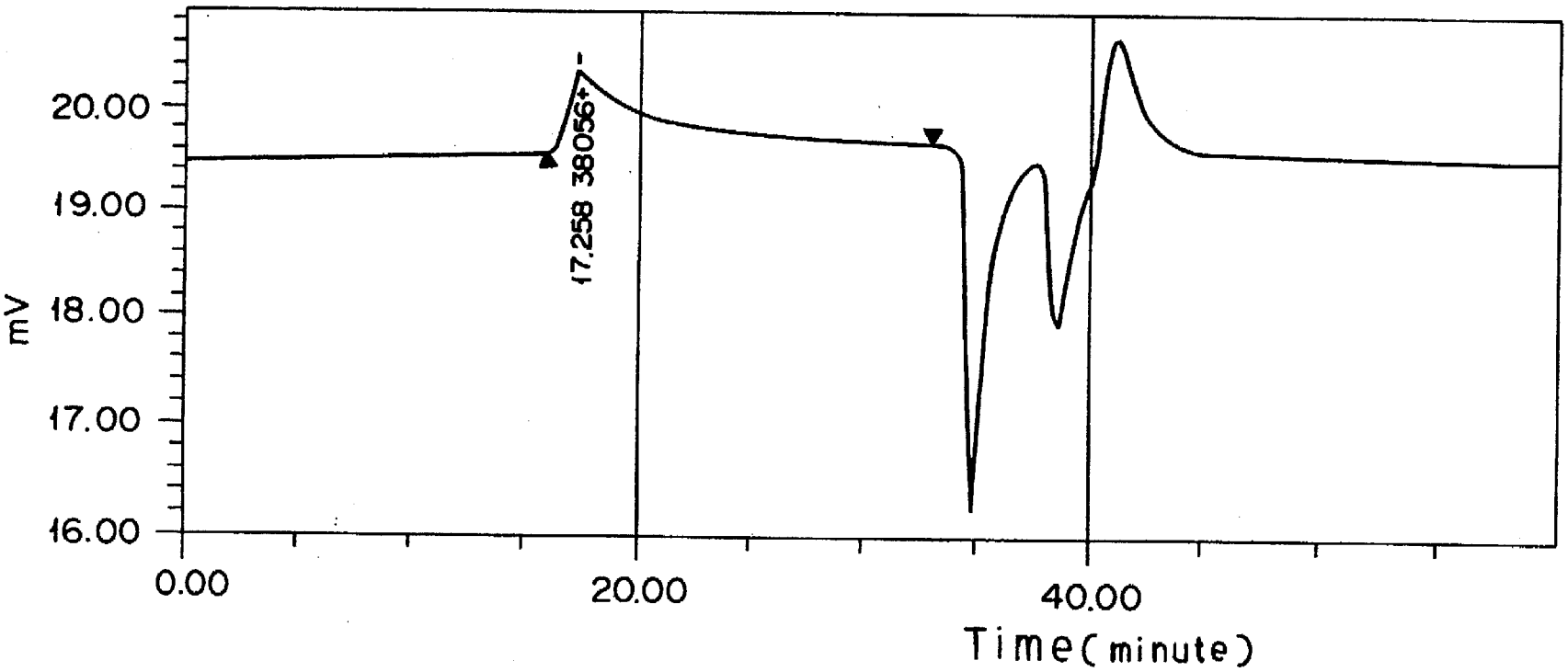
FIG. 2 is a chart of measurement by GPC of the weight weight-average molecular weight of a high molecular copolymer for use in the present invention.
Figure 3:
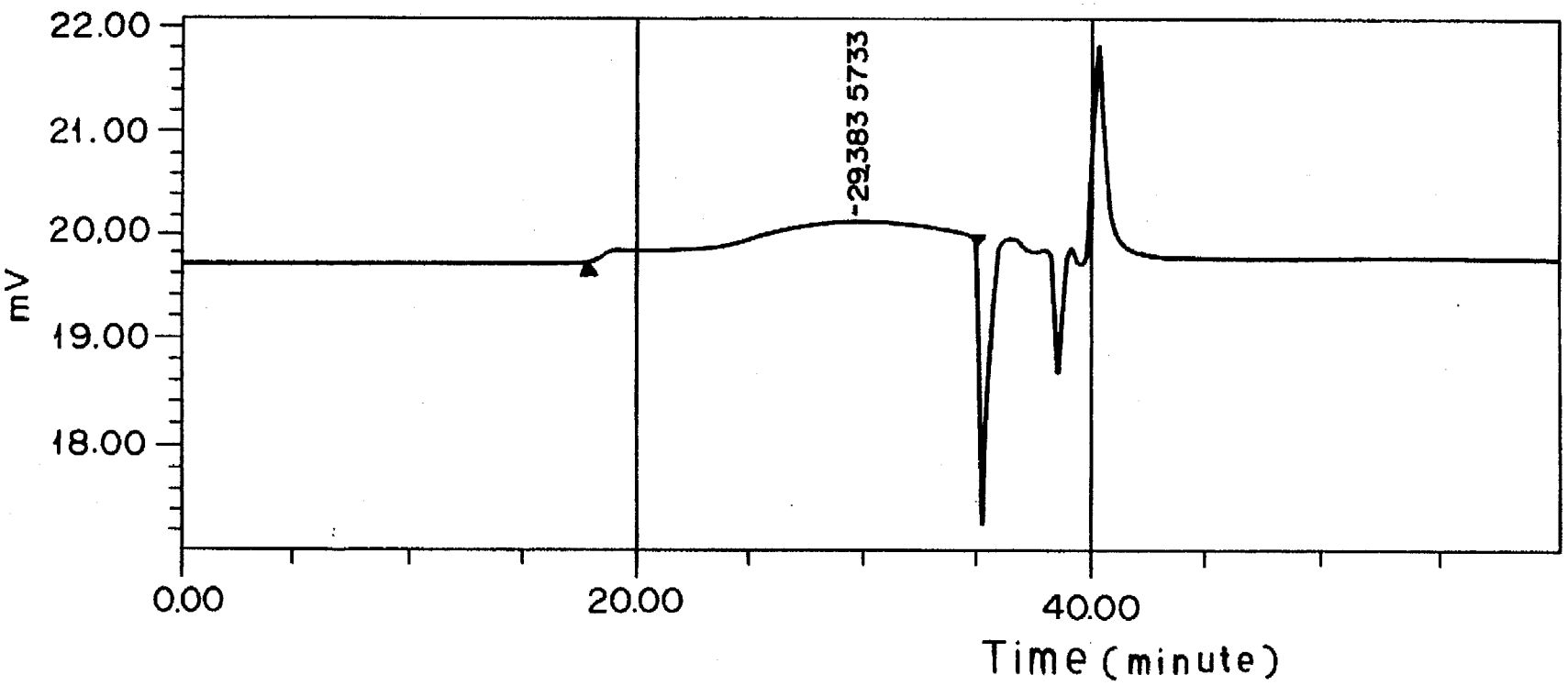
FIG. 3 is a chart of measurement by GPC of the weight weight-average molecular weight of a dispersant according to this invention.

The low molecular copolymers (a-9) shown in Tables 1 to 3, the high molecular copolymers (b-1) shown in Tables 4 to 6, and the dispersants ((a-9)/(b-1)=80/20 (weight ratio)) of Example 18 (and Example 52) shown in Table 7 (and Table 9) were analyzed by gel permeation chromatography (GPC) to determine their weight weight-average molecular weights. In this determination, one column each or TOSOH G-4000SWXL, G-3000SWXL, and G-2000SWXL were used and an acetic acid buffer (pH 6)/acetonitrile=65/35 (weight ratio) was used as an eluant. The charts depicting the results were as shown in FIG. 1 (low molecular copolymer (a-9)), FIG. 2 [high molecular copolymer (b-1)], and FIG. 3 [(a-9)/(b-1) mixed dispersant).

The carbonaceous solid-water slurries consequently obtained were tested for viscosity at 25° C. to examine their fluidity. The results of the rating performed immediately after the production of the carbonaceous solid-water slurry and one month thereafter were as shown in Tables 11 to 14. In the data of these tables, the values of viscosity decreased in proportion to the increase in the desirability of fluidity. The concentration of a lower layer part of a given slurry was determined or a sample which was obtained by freezing the slurry as held in a container and cutting the lower layer part or the frozen slurry. The stability of slurry decreased in proportion to the increase of difference between the concentration or the lower layer part and that of the carbonaceous solid at the time of its preparation. The term "lower layer part" refers to the part equivalent to 5% by volume of the whole slurry from the bottom of the container. The physical condition of the carbonaceous solid used herein is shown in Table 15.

Comparative Examples 1 to 8

For the purpose of comparison, comparative additives which failed to fulfil the essential requirements of this invention as shown in Tables 7 to 10 were similarly prepared and tested. The results were as shown in Table 11 to 14.

TABLE 1

Copolymer (a) with Low-molecular Weight

Monomer (A)

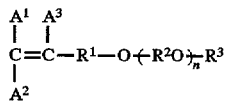

| Polymer No. | $A^1$ | $A^2$ | $A^3$ | $R^1$ | $R^2$ | n | $R^3$ | Molar ratio |
|---|---|---|---|---|---|---|---|---|
| 1 | H | H | H | CO | $C_2H_4$ | 20 | $CH_3$ | |

TABLE 1-continued

Copolymer (a) with Low-molecular Weight

Monomer (A)

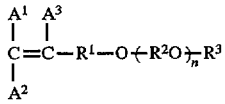

| Polymer No. | $A^1$ | $A^2$ | $A^3$ | $R^1$ | $R^2$ | n | $R^3$ | Molar ratio |
|---|---|---|---|---|---|---|---|---|
| 2 | H | H | $CH_3$ | CO | $C_2H_4$ | 50 | $C_2H_5$ | |
| 3 | H | H | $CH_3$ | CO | $C_2H_4$ | 20 | Phenyl | |
| 4 | H | H | H | CO | $C_2H_4$ | 90 | $CH_3$ | |
| 5 | H | H | $CH_3$ | $C_2H_4$ | $C_2H_4$ | 15 | Benzyl | |
| 6 | H | H | H | $CH_2$ | $C_2H_4$ | 15 | Naphthyl | |
| | | | | | $C_3H_6$ | 5 | | |
| 7 | H | H | $CH_3$ | CO | $C_2H_4$ | 50 | $C_{18}H_{37}$ | |
| 8 | $CH_3$ | H | H | CO | $C_2H_4$ | 10 | Naphthyl | |
| 9 | H | H | $CH_3$ | CO | $C_2H_4$ | 10 | Benzyl | |
| | | | | | $C_3H_6$ | 5 | | |
| 10 | H | H | $CH_3$ | CO | $C_2H_4$ | 20 | | |
| 11 | $CH_3$ | $CH_3$ | H | $CH_2$ | $C_3H_6$ | 5 | $CH_3$ | |
| 12 | COONa | H | H | CO | $C_2H_4$ | 10 | Phenyl | 80 |
| | $CH_3$ | $CH_3$ | H | $CH_2$ | $C_3H_6$ | 5 | $CH_3$ | 20 |
| 13 | H | H | $CH_3$ | CO | $C_2H_4$ | 20 | $C_{12}H_{25}$ | |
| 14 | H | H | H | CO | $C_2H_4$ | 5 | $CH_3$ | |
| 15 | H | H | H | CO | $C_2H_4$ | 50 | Naphthyl | |
| 16 | H | H | H | CO | $C_3H_6$ | 10 | | |
| 17 | H | H | $CH_3$ | CO | $C_2H_4$ | 20 | Phenyl | 50 |
| | H | H | H | CO | $C_2H_4$ | 20 | Phenyl | 50 |

TABLE 2

Copolymer (a) with Low-molecular Weight

Monomer (B-1)

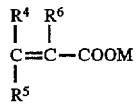

Monomer (B-2)

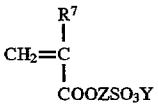

| Polymer No. | $R^4$ | $R^5$ | $R^6$ | M | Molar ratio | $R^7$ | Z | Y | Molar ratio |
|---|---|---|---|---|---|---|---|---|---|
| 1 | H | H | $CH_3$ | K | | | | | |
| 2 | H | H | H | Na | | | | | |
| 3 | H | H | $CH_3$ | $NH_3CH_2CH_2OH$ | 50 | | | | |
| | H | H | H | $NH_3CH_2CH_2OH$ | 50 | | | | |
| 4 | H | H | $CH_3$ | Na | 20 | | | | |
| | H | H | H | Na | 60 | | | | |
| | $COONH_4$ | H | H | $NH_4$ | 10 | | | | |
| 5 | H | H | H | Na | | | | | |
| 6 | H | H | H | Na | 80 | | | | |
| | COONa | H | H | | 20 | | | | |
| 7 | H | H | H | Ca | | $CH_3$ | $C_2H_4$ | Na | 90 |
| | | | | | | | | Ca | 10 |
| 8 | H | H | $CH_3$ | $NH_4$ | 70 | $CH_3$ | $C_2H_4$ | $NH_4$ | 20 |
| | H | H | H | $NH_4$ | 30 | H | $C_2H_4$ | $NH_4$ | 80 |
| 9 | H | H | $CH_3$ | Na | | $CH_3$ | $C_2H_4$ | Na | 70 |
| | | | | | | H | $C_2H_4$ | Na | 30 |
| 10 | H | H | $CH_3$ | Na | 60 | H | $C_2H_4$ | K | 50 |
| | H | H | H | Na | 30 | H | $C_3H_6$ | K | 50 |
| | COONa | H | H | | 10 | | | | |
| 11 | H | H | $CH_3$ | $NH_4$ | 20 | $CH_3$ | $C_2H_4$ | $NH_4$ | |
| | H | H | H | | 80 | | | | |
| 12 | H | H | $CH_3$ | Na | | $CH_3$ | $C_2H_4$ | Na | |
| 13 | H | H | $CH_3$ | Na | 40 | H | $C_2H_4$ | Na | |
| | H | H | H | Na | 40 | | | | |
| 14 | | | | | | H | $C_2H_4$ | Na | |
| 15 | | | | | | $CH_3$ | $C_2H_4$ | Na | 50 |
| | | | | | | H | $C_2H_4$ | Na | 50 |
| 16 | | | | | | H | $C_2H_4$ | $NH_3CH_2CH_2OH$ | |

TABLE 2-continued

Copolymer (a) with Low-molecular Weight

Monomer (B-1)

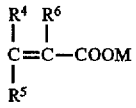

Monomer (B-2)

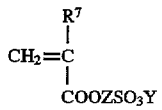

| Polymer No. | $R^4$ | $R^5$ | $R^6$ | M | Molar ratio | $R^7$ | Z | Y | Molar ratio |
|---|---|---|---|---|---|---|---|---|---|
| 17 | | | | | | H | $C_2H_4$ | K | 80 |
| | | | | | | | $C_3H_6$ | K | 20 |

TABLE 3

| Polymer No. | Low molecular weight copolymer (a) Polymer (C) | Monomer component (mol %) (A)/(B-1)/(B-2)/(C) | Weight average molecular weight ($\times 10^4$) | Adsorption rate for carbon aceous solid (%) | Adsorption rate for claysih mineral (%) |
|---|---|---|---|---|---|
| 1 | — | 20/80/0/0 | 1.0 | 40 | 25 |
| 2 | Acrylamide | 10/87/0/3 | 1.9 | 51 | 31 |
| 3 | — | 2/98/0/0 | 0.5 | 29 | 20 |
| 4 | 2-acrylamide-2-methyl propane sulphonic acid sodium | 1/54/0/45 | 2.2 | 20 | 27 |
| 5 | — | 0.2/99.8/0/0 | 3.2 | 13 | 36 |
| 6 | — | 1/99/0/0 | 0.7 | 27 | 22 |
| 7 | — | 0.8/80/19.2/0 | 3.7 | 50 | 35 |
| 8 | — | 3/60/37/0 | 0.3 | 25 | 10 |
| 9 | | 4/45/51/0 | 0.8 | 41 | 16 |
| 10 | | 8/27/65/0 | 1.5 | 47 | 17 |
| 11 | Styrene | 0.8/80/18.2/1 | 1.7 | 6 | 29 |
| 12 | — | 0.5/64.5/35/0 | 1.4 | 10 | 24 |
| 13 | — | 3/15/82/0 | 2.5 | 47 | 17 |
| 14 | | 0.2/0/99.8/0 | 3.0 | 8 | 10 |
| 15 | 2-acrylamide-2-methyl propane sulphonic acid sodium | 2/0/55/43 | 1.9 | 45 | 15 |
| 16 | — | 3/0/97/0 | 0.5 | 33 | 5 |
| 17 | | 10/0/90/0 | 1.5 | 48 | 7 |

TABLE 4

Copolymer (b) with High-molecular Weight

Monomer (A)

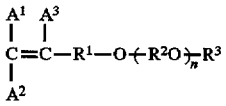

| Polymer No. | $A^1$ | $A^2$ | $A^3$ | $R^1$ | $R^2$ | n | $R^3$ | Molar ratio |
|---|---|---|---|---|---|---|---|---|
| 1 | H | H | H | CO | $C_2H_4$ | 20 | $CH_3$ | |
| 2 | H | H | H | CO | $C_2H_4$ | 50 | Naphthyl | |
| 3 | H | H | H | CO | $C_2H_4$ | 10 | Phenyl | |
| 4 | H | H | H | CO | $C_2H_4$ | 90 | $CH_3$ | |
| 5 | H | H | $CH_3$ | $C_2H_4$ | $C_2H_4$ | 15 | Benzyl | |
| 6 | H | H | H | $CH_2$ | $C_2H_4$ | 15 | Naphthyl | |
| | | | | | $C_3H_6$ | 5 | | |
| 7 | H | H | $CH_3$ | CO | $C_2H_4$ | 50 | $C_{18}H_{37}$ | |
| 8 | $CH_3$ | H | H | CO | $C_2H_4$ | 10 | Naphthyl | |
| 9 | H | H | $CH_3$ | CO | $C_2H_4$ | 10 | Benzyl | |
| | | | | | $C_3H_6$ | 5 | | |

TABLE 4-continued

Copolymer (b) with High-molecular Weight

Monomer (A)

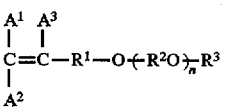

| Polymer No. | $A^1$ | $A^2$ | $A^3$ | $R^1$ | $R^2$ | n | $R^3$ | Molar ratio |
|---|---|---|---|---|---|---|---|---|
| 10 | H | H | $CH_3$ | CO | $C_2H_4$ | 20 | Pyridinyl | |
| 11 | H | H | $CH_3$ | CO | $C_2H_4$ | 10 | Benzyl | |
| 12 | | | | | $C_3H_6$ | 5 | | |
| | H | H | $CH_3$ | CO | $C_2H_4$ | 20 | Pyridinyl | |
| 13 | H | H | $CH_3$ | CO | $C_2H_4$ | 20 | $C_{12}H_{25}$ | |
| 14 | H | H | H | CO | $C_2H_4$ | 5 | $CH_3$ | |
| 15 | H | H | H | CO | $C_2H_4$ | 50 | Naphthyl | |
| 16 | $CH_3$ | $CH_3$ | H | $CH_2$ | $C_3H_6$ | 5 | $CH_3$ | |
| 17 | COONa | H | H | CO | $C_2H_4$ | 10 | Phenyl | 80 |
| | $CH_3$ | $CH_3$ | H | $CH_2$ | $C_3H_6$ | 5 | $CH_3$ | 20 |

TABLE 5

Copolymer (a) with High-molecular Weight

Monomer (B-1)

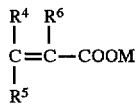

Monomer (B-2)

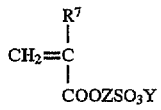

| Polymer No. | $R^4$ | $R^5$ | $R^6$ | M | Molar ratio | $R^7$ | Z | Y | Molar ratio |
|---|---|---|---|---|---|---|---|---|---|
| 1 | H | H | $CH_3$ | Na | | | | | |
| 2 | H | H | H | K | | | | | |
| 3 | H | H | $CH_3$ | $NH_3CH_2CH_2OH$ | 70 | | | | |
| | H | H | H | $NH_3CH_2CH_2OH$ | 30 | | | | |
| 4 | H | H | $CH_3$ | $NH_4$ | 20 | | | | |
| | H | H | H | $NH_4$ | 60 | | | | |
| | $COONH_4$ | H | H | $NH_4$ | 10 | | | | |
| 5 | H | H | H | Na | | | | | |
| 6 | H | H | $CH_3$ | Na | 80 | | | | |
| | COONa | H | H | | 20 | | | | |
| 7 | H | H | H | Na | | $CH_3$ | $C_2H_4$ | Na | 90 |
| | | | | | | | | Ca | 10 |
| 8 | H | H | $CH_3$ | $NH_4$ | 50 | $CH_3$ | $C_2H_4$ | $NH_4$ | 20 |
| | H | H | H | $NH_4$ | 50 | H | $C_2H_4$ | $NH_4$ | 80 |
| 9 | H | H | $CH_3$ | Ca | | $CH_3$ | $C_2H_4$ | Na | 70 |
| | | | | | | H | $C_2H_4$ | Na | 30 |
| 10 | H | H | $CH_3$ | Na | 60 | H | $C_2H_4$ | K | 50 |
| | H | H | H | Na | 30 | H | $C_3H_6$ | K | 50 |
| | COONa | H | H | | 10 | | | | |
| 11 | H | H | $CH_3$ | $NH_4$ | 20 | H | $C_2H_4$ | $NH_4$ | |
| | H | H | H | | 80 | | | | |
| 12 | H | H | H | Na | | H | $C_2H_4$ | Na | |
| 13 | H | H | $CH_3$ | Na | 40 | $CH_3$ | $C_2H_4$ | Na | |
| | H | H | H | Na | 40 | | | | |
| | COONa | H | H | | 20 | | | | |
| 14 | | | | | | H | $C_2H_4$ | K | |
| 15 | | | | | | $CH_3$ | $C_2H_4$ | Na | 50 |
| | | | | | | H | $C_2H_4$ | Na | 50 |
| 16 | | | | | | $CH_3$ | $C_2H_4$ | $NH_3CH_2CH_2OH$ | |
| 17 | | | | | | H | $C_2H_4$ | Na | 90 |
| | | | | | | | $C_3H_6$ | Na | 10 |

TABLE 6

High molecular weight copolymer (b)

| Polymer No. | Polymer (C) | Monomer component (mol %) (A)/(B-1)/(B-2)/(C) | Weight average molecular weight ($\times 10^4$) | Adsorption rate for carbon aceous solid (%) | Adsorption rate for claysih mineral (%) |
|---|---|---|---|---|---|
| 1 | — | 20/80/0/0 | 10 | 68 | 46 |
| 2 | Acrylamide | 9/87/0/4 | 200 | 100 | 75 |
| 3 | — | 3/97/0/0 | 20 | 95 | 52 |
| 4 | 2-acrylamide-2-methyl propane sulphonic acid sodium | 1/74/0/25 | 40 | 52 | 50 |
| 5 | — | 0.2/99.8/0/0 | 30 | 55 | 44 |
| 6 | — | 2/98/0/0 | 30 | 98 | 56 |
| 7 | — | 0.8/70/29.2/0 | 4 | 50 | 40 |
| 8 | — | 3/60/37/0 | 100 | 94 | 63 |
| 9 | | 4/45/51/0 | 7 | 83 | 40 |
| 10 | | 6/47/47/0 | 5 | 75 | 40 |
| 11 | Styrene | 0.8/60/38.2/1 | 12 | 65 | 45 |
| 12 | — | 0.5/60/39.5/0 | 26 | 63 | 51 |
| 13 | — | 2/15/83/0 | 6 | 59 | 40 |
| 14 | | 0.5/0/99.5/0 | 80 | 60 | 42 |
| 15 | 2-acrylamide-2-methyl propane sulphonic acid sodium | 10/0/55/35 | 35 | 97 | 41 |
| 16 | — | 2/0/98/0 | 70 | 65 | 45 |
| 17 | | 6/0/94/0 | 11 | 90 | 41 |

TABLE 7

| | Dispersant | | |
|---|---|---|---|
| | Polymer (a) | Polymer (b) | (a)/(b) Weight ratio |
| Example 1 | (1) | (1) | 10/90 |
| Example 2 | (1) | (3) | 20/80 |
| Example 3 | (2) | (5) | 30/70 |
| Example 4 | (2) | (7) | 40/60 |
| Example 5 | (3) | (9) | 50/50 |
| Example 6 | (3) | (11) | 60/40 |
| Example 7 | (4) | (13) | 70/30 |
| Example 8 | (4) | (15) | 80/20 |
| Example 9 | (5) | (17) | 90/10 |
| Example 10 | (5) | (2) | 95/5 |
| Example 11 | (6) | (4) | 10/90 |
| Example 12 | (6) | (6) | 20/80 |
| Example 13 | (7) | (8) | 30/70 |
| Example 14 | (7) | (10) | 40/60 |
| Ezample 15 | (8) | (12) | 50/50 |
| Example 16 | (8) | (14) | 60/40 |
| Example 17 | (9) | (16) | 70/30 |
| Example 18 | (9) | (1) | 80/20 |
| Example 19 | (10) | (3) | 90/10 |
| Example 20 | (10) | (5) | 95/5 |

TABLE 8

| | Dispersant | | |
|---|---|---|---|
| | Polymer (a) | Polymer (b) | (a)/(b) Weight ratio |
| Example 21 | (11) | (7) | 10/90 |
| Example 22 | (11) | (9) | 20/80 |
| Ezample 23 | (12) | (11) | 30/70 |
| Example 24 | (12) | (13) | 40/60 |
| Ezample 25 | (13) | (15) | 50/50 |
| Example 26 | (13) | (17) | 60/40 |
| Ezample 27 | (14) | (2) | 70/30 |
| Example 28 | (14) | (4) | 80/20 |
| Example 29 | (15) | (6) | 90/10 |
| Ezample 30 | (15) | (8) | 95/5 |
| Example 31 | (16) | (10) | 20/80 |
| Example 32 | (16) | (12) | 40/60 |
| Example 33 | (17) | (14) | 60/40 |
| Example 34 | (17) | (16) | 80/20 |
| Example 35 | (3) | (11) | 99/1 |
| Control 1 | Low molecular weight polymer (a)-(1) | | |
| Control 2 | High molecular weight polymer (b)-(1) | | |
| Control 3 | Formalin comdensation of sodium naphtharen sulfonic acid | | |
| Control 4 | Formalin condensation of phenol with EO adduct | | |

TABLE 9

| | Dispersant | | |
|---|---|---|---|
| | Polymer (a) | Polymer (b) | (a)/(b) Weight ratio |
| Example 36 | (1) | (1) | 10/90 |
| Example 37 | (1) | (3) | 20/80 |
| Example 38 | (2) | (5) | 30/70 |
| Example 39 | (2) | (7) | 40/60 |
| Example 40 | (3) | (9) | 50/50 |
| Example 41 | (3) | (11) | 60/40 |
| Example 42 | (4) | (13) | 70/30 |
| Example 43 | (4) | (15) | 80/20 |
| Example 44 | (5) | (17) | 90/10 |
| Ezample 45 | (5) | (2) | 95/5 |
| Example 46 | (6) | (4) | 10/90 |
| Example 47 | (6) | (6) | 20/80 |
| Example 48 | (7) | (8) | 30/70 |
| Example 49 | (7) | (10) | 40/60 |
| Example 50 | (8) | (12) | 50/50 |
| Example 51 | (8) | (14) | 60/40 |
| Example 52 | (9) | (16) | 70/30 |
| Example 53 | (9) | (1) | 80/20 |
| Example 54 | (10) | (3) | 90/10 |
| Example 55 | (10) | (5) | 95/5 |

TABLE 10

| | Dispersant | | |
|---|---|---|---|
| | Polymer (a) | Polymer (b) | (a)/(b) (Weight ratio) |
| Example 56 | (11) | (4) | 10/90 |
| Example 57 | (11) | (5) | 20/80 |
| Example 58 | (12) | (6) | 30/70 |
| Example 59 | (12) | (7) | 40/60 |
| Example 60 | (13) | (8) | 50/50 |
| Example 61 | (13) | (9) | 60/40 |
| Example 62 | (14) | (10) | 70/30 |
| Example 63 | (14) | (11) | 80/20 |
| Example 64 | (15) | (12) | 90/10 |
| Example 65 | (15) | (13) | 95/5 |
| Example 66 | (16) | (14) | 20/80 |
| Example 67 | (16) | (15) | 40/60 |
| Example 68 | (17) | (16) | 60/40 |
| Example 69 | (17) | (17) | 80/20 |
| Example 70 | (15) | (3) | 99/1 |
| Control 5 | Low molecular weight polymer (a)-(1) | | |
| Control 6 | High molecular weight polymer (b)-(1) | | |
| Control 7 | Formalin comdensation of sodium naphtharen sulfonic acid | | |
| Control 8 | Formalin condensation of phenol with EO adduct | | |

TABLE 11

| | Physical property of carbonaceous solid-water slurry | | | | | | | | | | |
|---|---|---|---|---|---|---|---|---|---|---|---|
| | Amount to be added(wt %, based on carbonaceous solid) | Kind of carbonaceous solid | Concentration of Carbonaceous solid(wt %) | Temperature for slurry preparation (°C.) | Slurry pH | Fluidity: Slurry viscosity (cps) | Fluidity: Fluidity (note) | One month after preparation (left standing): Slurry viscosity (cps) | One month after preparation (left standing): Fluidity (note) | One month after preparation (left standing): Concentration of lower byer part (wt %) | One month after preparation (left standing): Stability |
| Example 1 | 0.4 | (1) | 69.0 | 20 | 8.3 | 1130 | ○ | 1200 | ○ | 70.4 | ○ |
| Example 2 | 0.4 | (1) | 69.1 | 20 | 9.0 | 1150 | ○ | 1150 | ○ | 70.3 | ○ |
| Example 3 | 0.4 | (1) | 68.8 | 20 | 8.8 | 1150 | ○ | 1160 | ○ | 70.1 | ○ |
| Example 4 | 0.3 | (1) | 69.1 | 20 | 10.7 | 1120 | ○ | 1070 | ○ | 70.0 | ○ |
| Example 5 | 0.3 | (1) | 68.9 | 30 | 7.5 | 1010 | ○ | 1050 | ○ | 69.8 | ○ |
| Example 6 | 0.4 | (1) | 69.2 | 30 | 8.0 | 1000 | ○ | 1040 | ○ | 70.1 | ○ |
| Example 7 | 0.4 | (1) | 69.1 | 30 | 7.5 | 1020 | ○ | 1080 | ○ | 70.0 | ○ |
| Example 8 | 0.3 | (1) | 69.0 | 30 | 9.0 | 1050 | ○ | 1070 | ○ | 69.9 | ○ |
| Example 9 | 0.3 | (1) | 68.9 | 40 | 8.7 | 1060 | ○ | 1060 | ○ | 69.7 | ○ |
| Example 10 | 0.3 | (1) | 68.8 | 40 | 8.0 | 1120 | ○ | 1100 | ○ | 70.2 | ○ |
| Example 11 | 0.4 | (1) | 69.2 | 40 | 9.5 | 1150 | ○ | 1160 | ○ | 70.4 | ○ |
| Example 12 | 0.3 | (1) | 69.0 | 40 | 10.3 | 1100 | ○ | 1200 | ○ | 70.3 | ○ |
| Example 13 | 0.3 | (1) | 69.1 | 50 | 10.5 | 1200 | ○ | 1240 | ○ | 70.3 | ○ |
| Example 14 | 0.4 | (1) | 68.9 | 50 | 7.3 | 1030 | ○ | 1050 | ○ | 69.8 | ○ |
| Example 15 | 0.3 | (1) | 69.2 | 50 | 8.5 | 1030 | ○ | 1070 | ○ | 70.1 | ○ |
| Example 16 | 0.4 | (1) | 69.0 | 50 | 7.3 | 1010 | ○ | 1060 | ○ | 69.9 | ○ |
| Example 17 | 0.4 | (1) | 69.2 | 60 | 9.5 | 1040 | ○ | 1050 | ○ | 69.1 | ○ |
| Example 18 | 0.3 | (1) | 68.8 | 60 | 8.3 | 1060 | ○ | 1020 | ○ | 69.7 | ○ |
| Example 19 | 0.3 | (i) | 69.1 | 60 | 8.0 | 1000 | ○ | 1050 | ○ | 70.0 | ○ |
| Example 20 | 0.4 | (1) | 69.1 | 60 | 9.5 | 1150 | ○ | 1160 | ○ | 70.3 | ○ |

(Note) ○: Good X: Inferior

TABLE 12

| | Physical property of carbonaceous solid-water slurry | | | | | | | | | | | |
|---|---|---|---|---|---|---|---|---|---|---|---|---|
| | | | | | | | | | One month after preparation (left standing) | | | |
| | Amount to be added(wt %, based on carbonaceous olid) | Chelate agent | Kind of carbonaceous solid | Concentration of Carbonaceous solid(wt %) | Temperature for slurry preparation (°C.) | Slurry pH | Fluidity: Slurry viscosity (cps) | Fluidity: Fluidity (note) | Slurry viscosity (cps) | Fluidity (note) | Concentration of lower byer part (wt %) | Stability |
| Example 21 | 0.3 | | (1) | 68.8 | 70 | 10.3 | 1100 | ○ | 1200 | ○ | 70.1 | ○ |
| Example 22 | 0.3 | | (1) | 69.0 | 70 | 9.7 | 1160 | ○ | 1170 | ○ | 70.2 | ○ |
| Example 23 | 0.4 | | (1) | 68.9 | 70 | 10.5 | 1130 | ○ | 1140 | ○ | 70.1 | ○ |
| Example 24 | 0.3 | | (1) | 68.9 | 70 | 7.3 | 1020 | ○ | 1070 | ○ | 69.7 | ○ |
| Example 25 | 0.4 | | (1) | 69.1 | 70 | 8.5 | 1010 | ○ | 1030 | ○ | 70.0 | ○ |
| Example 26 | 0.4 | | (1) | 68.8 | 80 | 7.3 | 1000 | ○ | 1050 | ○ | 69.6 | ○ |
| Example 27 | 0.3 | | (1) | 69.0 | 80 | 9.5 | 1030 | ○ | 1020 | ○ | 69.9 | ○ |
| Example 28 | 0.4 | | (1) | 69.2 | 80 | 8.3 | 1000 | ○ | 1070 | ○ | 70.1 | ○ |
| Example 29 | 0.4 | | (1) | 68.9 | 80 | 9.0 | 1050 | ○ | 1050 | ○ | 70.1 | ○ |
| Example 30 | 0.4 | | (1) | 69.1 | 80 | 8.8 | 1200 | ○ | 1200 | ○ | 70.3 | ○ |
| Example 31 | 0.3 | | (1) | 69.0 | 90 | 10.7 | 1120 | ○ | 1180 | ○ | 70.2 | ○ |
| Example 32 | 0.3 | | | 69.1 | 90 | 7.5 | 1020 | ○ | 1050 | ○ | 70.0 | ○ |
| Example 33 | 0.4 | | (1) | 69.1 | 90 | 8.0 | 1010 | ○ | 1050 | ○ | 70.0 | ○ |
| Example 34 | 0.4 | | (1) | 69.2 | 90 | 7.5 | 1050 | ○ | 1100 | ○ | 70.1 | ○ |
| Example 35 | 0.4 | Sodium tripolyphosphate | (1) | 70.6 | 60 | 9.0 | 1050 | ○ | 1030 | ○ | 74.5 | ○ |
| Control 1 | 0.4 | | (1) | 68.1 | 70 | 10.8 | 1250 | ○ | 930 | ○ | 74.5 | X |
| Control 2 | 0.3 | | (1) | 67.0 | 80 | 8.3 | 1300 | ○ | 1020 | ○ | 71.1 | Δ |
| Control 3 | 0.8 | | (1) | 64.0 | 50 | 10.0 | 2350 | Δ | 4900 | X | 73.3 | X |
| Control 4 | 1.5 | | (1) | 65.2 | 30 | 9.5 | 2500 | Δ | 5500 | X | 73.5 | X |

(Note) ○: Good X: Inferior

TABLE 13

| | Physical property of carbonaceous solid-water slurry | | | | | | | | | | |
|---|---|---|---|---|---|---|---|---|---|---|---|
| | Amount to be added(wt %, based on carbonaceous olid) | Kind of carbonaceous solid | Concentration of Carbonaceous solid(wt %) | Temperature for slurry preparation (°C.) | Slurry pH | Fluidity: Slurry viscosity (cps) | Fluidity: Fluidity (note) | One month after preparation (left standing): Slurry viscosity (cps) | One month after preparation (left standing): Fluidity (note) | One month after preparation (left standing): Concentration of lower byer part (wt %) | One month after preparation (left standing): Stability |
| Example 36 | 0.4 | (2) | 69.8 | 20 | 8.3 | 1100 | ○ | 1200 | ○ | 71.2 | ○ |
| Example 37 | 0.4 | (2) | 69.9 | 20 | 9.0 | 1150 | ○ | 1150 | ○ | 71.3 | ○ |
| Example 38 | 0.4 | (2) | 70.0 | 20 | 8.8 | 1100 | ○ | 1160 | ○ | 71.2 | ○ |
| Example 39 | 0.3 | (2) | 70.0 | 20 | 10.7 | 1020 | ○ | 1080 | ○ | 70.9 | ○ |
| Example 40 | 0.3 | (2) | 69.9 | 30 | 7.5 | 1000 | ○ | 1050 | ○ | 70.8 | ○ |
| Example 41 | 0.4 | (2) | 70.1 | 30 | 8.0 | 1050 | ○ | 1100 | ○ | 71.0 | ○ |
| Example 42 | 0.4 | (2) | 70.0 | 30 | 7.5 | 1020 | ○ | 1080 | ○ | 70.0 | ○ |
| Example 43 | 0.3 | (2) | 70.1 | 30 | 9.0 | 1050 | ○ | 1100 | ○ | 71.0 | ○ |
| Example 44 | 0.3 | (2) | 69.9 | 40 | 8.7 | 1000 | ○ | 1010 | ○ | 70.7 | ○ |
| Example 45 | 0.3 | (2) | 69.8 | 40 | 8.0 | 1170 | ○ | 1120 | ○ | 71.2 | ○ |
| Example 46 | 0.4 | (2) | 70.0 | 40 | 9.5 | 1150 | ○ | 1160 | ○ | 71.2 | ○ |
| Example 47 | 0.3 | (2) | 70.0 | 40 | 10.3 | 1040 | ○ | 1200 | ○ | 71.3 | ○ |
| Example 48 | 0.3 | (2) | 69.9 | 50 | 10.5 | 1200 | ○ | 1140 | ○ | 71.2 | ○ |
| Example 49 | 0.4 | (2) | 70.0 | 50 | 7.3 | 1030 | ○ | 1060 | ○ | 70.8 | ○ |
| Example 50 | 0.3 | (2) | 69.9 | 50 | 8.5 | 1000 | ○ | 1070 | ○ | 70.8 | ○ |
| Example 51 | 0.4 | (2) | 70.0 | 50 | 7.3 | 1010 | ○ | 1030 | ○ | 70.9 | ○ |
| Example 52 | 0.4 | (2) | 70.1 | 60 | 9.5 | 1000 | ○ | 1050 | ○ | 71.0 | ○ |
| Example 53 | 0.3 | (2) | 70.0 | 60 | 8.3 | 1030 | ○ | 1020 | ○ | 71.0 | ○ |
| Example 54 | 0.3 | (2) | 70.1 | 60 | 8.0 | 1010 | ○ | 1030 | ○ | 70.9 | ○ |
| Example 55 | 0.4 | (2) | 70.0 | 60 | 9.5 | 1150 | ○ | 1160 | ○ | 71.2 | ○ |

(Note) ○: Good X: Inferior

TABLE 14

| | Physical property of carbonaceous solid-water slurry | | | | | | | | | | | |
|---|---|---|---|---|---|---|---|---|---|---|---|---|
| | | | | | | | | | One month after preparation (left standing) | | | |
| | | | | | | | | | One month after preparation (left standing) | | | |
| | Amount to be added(wt %, based on carbonaceous solid) | Chelate agent | Kind of carbonaceous solid | Concentration of Carbonaceous solid(wt %) | Temperature for slurry preparation (°C.) | Slurry pH | Fluidity: Slurry viscosity (cps) | Fluidity: Fluidity (note) | Slurry viscosity (cps) | Fluidity (note) | Concentration of lower byer part (wt %) | Stability |
| Example 56 | 0.3 | | (2) | 70.0 | 70 | 10.3 | 1100 | ○ | 1200 | ○ | 71.2 | ○ |
| Example 57 | 0.3 | | (2) | 69.8 | 70 | 9.7 | 1160 | ○ | 1140 | ○ | 71.2 | ○ |
| Example 58 | 0.4 | | (2) | 70.0 | 70 | 10.5 | 1130 | ○ | 1110 | ○ | 71.3 | ○ |
| Example 59 | 0.3 | | (2) | 70.2 | 70 | 7.3 | 1000 | ○ | 1070 | ○ | 71.1 | ○ |
| Example 60 | 0.4 | | (2) | 70.1 | 70 | 8.5 | 1010 | ○ | 1030 | ○ | 70.9 | ○ |
| Example 61 | 0.4 | | (2) | 70.2 | 80 | 7.3 | 1040 | ○ | 1050 | ○ | 71.1 | ○ |
| Example 62 | 0.3 | | (2) | 69.9 | 80 | 9.5 | 1030 | ○ | 1020 | ○ | 70.8 | ○ |
| Example 63 | 0.4 | | (2) | 69.8 | 80 | 8.3 | 1000 | ○ | 1100 | ○ | 70.6 | ○ |
| Example 64 | 0.4 | | (2) | 70.2 | 80 | 9.0 | 1050 | ○ | 1050 | ○ | 71.1 | ○ |
| Example 65 | 0.4 | | (2) | 70.2 | 80 | 8.8 | 1200 | ○ | 1200 | ○ | 71.4 | ○ |
| Example 66 | 0.3 | | (2) | 70.1 | 90 | 10.7 | 1120 | ○ | 1180 | ○ | 71.4 | ○ |
| Example 67 | 0.3 | | | 69.9 | 90 | 7.5 | 1050 | ○ | 1050 | ○ | 70.8 | ○ |
| Example 68 | 0.4 | | (2) | 69.8 | 90 | 8.0 | 1200 | ○ | 1110 | ○ | 70.6 | ○ |
| Example 69 | 0.4 | | (2) | 70.1 | 90 | 7.5 | 1050 | ○ | 1020 | ○ | 71.0 | ○ |
| Example 70 | 0.4 | Sodium hexamath phosphate | (2) | 71.5 | 80 | 8.5 | 1020 | ○ | 1020 | ○ | 72.2 | ○ |
| Control 5 | 0.4 | | (2) | 69.1 | 80 | 10.8 | 1350 | ○ | 920 | ○ | 75.5 | X |
| Control 6 | 0.3 | | (2) | 67.9 | 60 | 8.3 | 1300 | ○ | 1020 | ○ | 72.3 | Δ |
| Control 7 | 0.8 | | (2) | 63.2 | 40 | 9.9 | 2820 | Δ | 4500 | X | 73.2 | X |
| Control 8 | 1.5 | | (2) | 64.1 | 20 | 10.2 | 2400 | Δ | 5200 | X | 74.6 | X |

(Note) ○: Good X: Inferior

TABLE 15

| Item | Industrial analysis: Intrinsic water (%) | Ash (%) | Volatile (%) | Fixed carbon (%) | Elemental analysis: Carbon (%) | Hydrogen (%) | Oxygen (%) | Nitrogen (%) | Sulpher (%) |
|---|---|---|---|---|---|---|---|---|---|
| Coal (1) | 3.8 | 13.0 | 28.2 | 54.5 | 73.3 | 4.8 | 6.6 | 1.8 | 0.5 |
| Coal (2) | — | 0.3 | 11.1 | 88.6 | 88.3 | 3.7 | 1.0 | 1.4 | 5.3 |

What is claimed is:

1. An additive for a high concentration carbonaceous solid-water slurry comprising a copolymer (a) and a copolymer (b) selected from the group of water-soluble copolymers obtained by polymerizing the monomer components, (A) from 0.2 to 20 mol % of a nonionic monomer represented by the formula (I):

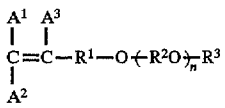

(I)

wherein $R^1$ stands for $—CH_2—$, $—(CH_2)_2—$, $—(CH_2)_3—$, $—C(CH_3)_2—$, —CO, $CH_2CO—$, $A^1$, $A^2$, and $A^3$ independently stand for a hydrogen atom or a methyl group where $R^1$ is $—CH_2—$, $—(CH_2)_2—$, $—(CH_2)_3—$, or $—C(CH_3)_2—$ or $A^1$ and $A^2$ independently stand for a hydrogen atom, a methyl group, or —COOX and $A^1$ and $A^2$ do not simultaneously stand for —COOX and $A^3$ stands for a hydrogen atom, a methyl group, —COOX, or $CH_2COOX$ where $R^1$ is CO or $—CH_2CO$ and $A^1$ and $A^2$ independently stand for a hydrogen atom or a methyl group where $A^3$ is —COOX or $—CH_2COOX$, wherein X stands for a hydrogen atom, an alkali metal atom, an alkaline earth metal atom, an ammonium group, or an organic amine group $R^2$ stands for an alkylene group of 2 to 4 carbon atoms, n stands for a number of an average in the range of from 1 to 100, $R^3$ stands for an alkyl group of 1 to 30 carbon atoms, an alkenyl group, an aryl group, an aralkyl group, a cyclic alkyl group, or a cyclic alkenyl group, or a monovalent organic group derived from a heterocyclic compound, (B) from 50 to 99.8 mol % of at least one anionic monomer selected from the group consisting of (B-1) an unsaturated carboxylic acid monomer represented by the formula (II):

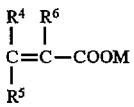

(II)

wherein $R^4$ and $R^5$ independently stand for a hydrogen atom, a methyl group, or —COOM and $R^4$ and $R^5$ do not simultaneously stand for —COOM, $R^6$ stands for a hydrogen atom, a methyl group, or $—CH_2COOM$, providing that $R^4$ and $R^5$ independently stand for a hydrogen atom or methyl group where $R^6$ is $—CH_2COOM$, and M stands for a hydrogen atom, an alkali metal atom, an alkaline earth metal atom, an ammonium group, or an organic amine group and (B-2) a sulfoalkyl(meth) acrylate type monomer represented by the formula (III):

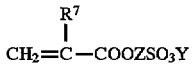

(III)

wherein $R^7$ stands for a hydrogen atom or a methyl group, Z stands for an alkylene group of 1 to 4 carbon atoms, and Y stands for a hydrogen atom, an alkali metal atom, an alkaline earth metal atom, an ammonium group, or an organic amine group, and (C) from 0 to 49.8 mol % of an other monomer co-polymerizable with any of the monomers (A), (B-1), or (B-2), selected from the group consisting of: methacrylic acid alkyl esters; vinyl sulfonic acid, styrene sulfonic acid, allyl sulfonic acid, methallyl sulfonic acid, and 2-acrylamide-2-methylpropane sulfonic acid, and the monovalent metal salts, divalent metal salts, ammonium salts, and organic amine salts of the said acids; hydroxyl group containing (meth)acrylates; (meth)acrylamides; styrene and p-methyl styrene; vinyl acetate, propenyl acetate; and vinyl chloride; and mixtures thereof, provided the total of the monomers of (A), (B-1), (B-2), and (C) is 100 mol % wherein said copolymer (a) is a water soluble low molecular copolymer made from 0.2 to 20 mol % of the nonionic monomer (A), 50 to 99.8 mol % of at least one anionic monomer (B), and 0 to 49.8 mol % of the other monomer (C), having a weight-average molecular weight in a range of from 1000 to 39000, an adsorption ratio relative to carbonaceous solids in a range of from 5 to 50%, and an adsorption ratio relative to clayish mineral particles in the range of from 5 to 40% and said copolymer (b) is a water soluble high molecular copolymer made from 0.2 to 20 mol % of the nonionic monomer (A), 50 to 99.8 mol % of at least one anionic monomer (B), and 0 to 49.8 mol % of the other monomer (C), having a weight-average molecular weight in a range not less than 40000, an adsorption ratio relative to carbonaceous solids in a range not less than 50%, and an adsorption ratio relative to clayish mineral particles in a range not less than 40% at a weight ratio, (a)/(b), in the range of from 10/90 to 99/1.

2. An additive according to claim 1, wherein the weight-average molecular weight of said lower molecular copolymer (a) is in the range of from 3000 to 39000 and the ratio of adsorption thereof relative to a carbonaceous solid is in a range of from 10 to 50% and the ratio of adsorption thereof relative to clayish mineral substance is in a range of from 10 to 40% and the weight-average molecular weight of said high molecular copolymer (b) is in a range of from 100,000 to 2,000,000 and the ratio of adsorption thereof relative to said carbonaceous solid is not less than 55% and the ratio of adsorption thereof relative to said clayish mineral is not less than 45%.

3. An additive according to claim 2, wherein the weight ratio of said low molecular copolymer (a) to said high molecular copolymer (b), (a)/(b), is in the range of from 40/60 to 95/5.

4. An additive according to claim 1, which further comprises a chelating agent.

5. An additive according to claim 4, wherein said chelating agent is at least one member selected from the group consisting of pyrophosphoric acid, tripolyphosphoric acid, and hexameta-phosphoric acid and alkali metal salts, alkaline earth metal salts, ammonium salts, and amine salts thereof.

6. A method for the production of an additive for a high concentration carbonaceous solid-water slurry which comprises mixing a water soluble low molecular copolymer (a) made from 0.2 to 20 mol % of the nonionic monomer (A), 50 to 99.8 mol % of at least one anionic monomer (B), and 0 to 49.8 mol % of the other monomer (C), having a weight-average molecular weight in a range of from 1000 to 39,000, an adsorption ratio relative to carbonaceous solids in a range of from 5 to 50%, and an adsorption ratio relative to clayish mineral particles in a range of from 5 to 40% and a water soluble high molecular copolymer (b) made from 0.2 to 20 mol % of the nonionic monomer (A), 50 to 99.8 mol % of at least one anionic monomer (B), and 0 to 49.8 mol % of the other monomer (C), having a weight-average molecular weight in a range not less than 40000, an adsorption ratio relative to carbonaceous solids in a range not less than 50%, and an adsorption ratio relative to clayish mineral particles in a range not less than 40% at a weight ratio of copolymer (a)/copolymer(b), in the range of from 10/90 to 99/1 by weight, said low molecular copolymer (a) and said high molecular copolymer (b) severally being one or more members selected from the group of water-soluble copolymers obtained by polymerizing the monomer components, (A) from 0.2 to 20 mol % of a nonionic monomer represented by the formula (I):

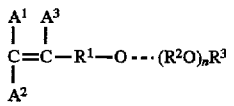

(I)

wherein $R^1$ stands for $—CH_2—$, $—(CH_2)_2—$, $—(CH_2)_3—$, $—C(CH_3)_2—$, —CO—, or $—CH_2CO—$, $A^1$, $A^2$, and $A^3$ independently stand for a hydrogen atom or a methyl group where $R^1$ is $—CH_2—$, $—(CH_2)_2—$, $—(CH_2)_3—$, or $—C(CH_3)_2—$ or $A^1$ and $A^2$ independently stand for a hydrogen atom, a methyl group, or —COOX and $A^1$ and $A^2$ do not simultaneously stand for —COOX and $A^3$ stands for a hydrogen atom, a methyl group, —COOX, or $—CH_2COOX$ where $R^1$ is CO or $—CH_2CO$ and $A^1$ and $A^2$ independently stand for a hydrogen atom or a methyl group where $A^3$ is —COOX or $—CH_2COOX$, wherein X stands for a hydrogen atom, an alkali metal atom, an alkaline earth metal atom, an ammonium group, or an organic amine group, $R^2$ stands for an alkylene group of 2 to 4 carbon atoms, n stands for a number of an average in the range of from 1 to 100, $R^3$ stands for an alkyl group of 1 to 30 carbon atoms, an alkenyl group, an aryl group, an aralkyl group, a cyclic alkyl group, or a cyclic alkenyl group, or a monovalent organic group derived from a heterocyclic compound, (B) from 50 to 99.8 mol % of at least one anionic monomer selected from the group consisting of (B-1) an unsaturated carboxylic acid monomer represented by the formula (II):

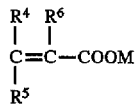

(II)

wherein $R^4$ and $R^5$ independently stand for a hydrogen atom, a methyl group, or —COOM and $R^4$ and $R^5$ do not simultaneously stand for —COOM, $R^6$ stands for a hydrogen atom, a methyl group, or $—CH_2COOM$, providing that $R^4$ and $R^5$ independently stand for a hydrogen atom or methyl group where $R^6$ is $—CH_2COOM$, and M stands for a hydrogen atom, an alkali metal atom, an alkaline earth metal atom, an ammonium group, or an organic amine group and (B-2) a sulfoalkyl(meth) acrylate type monomer represented by the formula (III):

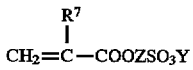

(III)

wherein $R^7$ stands for a hydrogen atom or a methyl group, Z stands for an alkylene group of 1 to 4 carbon atoms, and Y stands for a hydrogen atom, an alkali metal atom, an alkaline earth metal atom, an ammonium group, or an organic amine group, and (C) from 0 to 49.8 mol % of an other monomer copolymerizable with any of the monomers (A), (B-1) or (B-2)' selected from the group consisting of: methacrylic acid alkyl esters; vinyl sulfonic acid, styrene sulfonic acid, allyl sulfonic acid, methallyl sulfonic acid, and 2-acrylamide-2-methylpropane sulfonic acid, and the monovalent metal salts, divalent metal salts, ammonium salts, and organic amine salts of the said acids; hydroxyl group containing (meth)acrylates; (meth)acrylamides; styrene and p-methyl styrene; vinyl acetate, propenyl acetate, and vinyl chloride; and mixtures thereof, provided the total of the monomers of (A), (B-1), (B-2), and (C) is 100 mol %.

7. A carbonaceous solid-water slurry composition incorporating therein 40 to 90% by weight of a finely powdered carbonaceous solid and 0.02 to 2% by weight of the additive set forth in claim 1 based on the amount of said finely powdered carbonaceous solid.

8. A carbonaceous solid-water slurry composition incorporating therein 40 to 90% by weight of a finely powdered carbonaceous solid and 0.02 to 2% by weight of the additive set forth in claim 2 based on the amount of said finely powdered carbonaceous solid.

9. A carbonaceous solid-water slurry composition incorporating therein 40 to 90% by weight of a finely powdered carbonaceous solid and 0.02 to 2% by weight of the additive set forth in claim 3 based on the amount of said finely powdered carbonaceous solid.

10. A carbonaceous solid-water slurry composition incorporating therein 40 to 90% by weight or a finely powdered carbonaceous solid and 0.04 to 5% by weight of the additive set forth in claim 4 based on the amount of said finely powdered carbonaceous solid.

11. A carbonaceous solid-water slurry composition incorporating therein 40 to 90% by weight of a finely powdered carbonaceous solid and 0.04 to 5% by weight of the additive set forth in claim 5 based on the amount of said finely powdered carbonaceous solid.

* * * * *